US008302670B2

(12) United States Patent
Yang et al.

(10) Patent No.: US 8,302,670 B2
(45) Date of Patent: Nov. 6, 2012

(54) AIR GUIDE FOR AIR COOLED CONDENSER

(75) Inventors: Jidon Yang, Overland Park, KS (US); Glenn S. Brenneke, Lee's Summitt, MO (US); Eldon F. Mockry, Lenexa, KS (US)

(73) Assignee: SPX Cooling Technologies, Inc., Overland Park, KS (US)

( * ) Notice: Subject to any disclaimer, the term of this patent is extended or adjusted under 35 U.S.C. 154(b) by 1032 days.

(21) Appl. No.: 11/966,777

(22) Filed: Dec. 28, 2007

(65) Prior Publication Data

US 2009/0165993 A1 Jul. 2, 2009

(51) Int. Cl.
*F28F 9/00* (2006.01)
*F24H 3/06* (2006.01)

(52) U.S. Cl. ..... 165/67; 165/122

(58) Field of Classification Search ..... 165/110, 165/122, 124, 126, 900, 67
See application file for complete search history.

(56) References Cited

U.S. PATENT DOCUMENTS

| | | | | |
|---|---|---|---|---|
| 1,654,190 | A | 12/1927 | Primrose | |
| 2,907,554 | A | 10/1959 | Heller | |
| 3,385,197 | A | 5/1968 | Greber | |
| 3,612,712 | A * | 10/1971 | Kanger et al. | 415/110 |
| 3,743,257 | A | 7/1973 | Fordyce | |
| 3,814,177 | A | 6/1974 | Harris et al. | |
| 3,903,212 | A | 9/1975 | Lefevre | |
| 3,933,196 | A | 1/1976 | Heller et al. | |
| 4,031,173 | A | 6/1977 | Rogers | |
| 4,076,771 | A | 2/1978 | Houx, Jr. et al. | |
| 4,157,368 | A | 6/1979 | Fernandes | |
| 4,173,605 | A | 11/1979 | Long | |
| 4,278,620 | A | 7/1981 | Lefevre | |
| 4,421,303 | A | 12/1983 | Andrew | |
| 4,450,899 | A * | 5/1984 | Jakobsson et al. | 165/279 |
| 4,499,034 | A | 2/1985 | McAllister, Jr. | |
| 4,513,813 | A * | 4/1985 | Zanobini | 165/111 |
| 4,541,968 | A | 9/1985 | Ernst et al. | |
| 4,549,999 | A | 10/1985 | Ernst et al. | |
| 5,129,456 | A * | 7/1992 | Bodas et al. | 165/108 |
| 6,320,271 | B1 | 11/2001 | Hill et al. | |
| 6,880,622 | B1 * | 4/2005 | Gu | 165/96 |
| 2004/0217072 | A1 | 11/2004 | Bash et al. | |
| 2005/0006050 | A1 | 1/2005 | Schrey et al. | |

FOREIGN PATENT DOCUMENTS

| | | |
|---|---|---|
| GB | 464531 A | 4/1937 |
| GB | 1 176 535 | 1/1970 |

* cited by examiner

*Primary Examiner* — Cheryl J Tyler
*Assistant Examiner* — Ignacio E Landeros
(74) *Attorney, Agent, or Firm* — Baker & Hostetler LLP

(57) ABSTRACT

An air cooled condensing tower system has a framework supporting a fan deck, a plurality of steam headers running longitudinally above the fan deck, a plurality of condensing coils extending downward and at an angle from the steam headers, and above the fan deck, a plurality of collector tubes disposed at the bottom of the condenser coils and above the fan deck. At least one substantially non-porous side wall is disposed on at least one side of the tower spanning from a height generally proximate the steam supply headers downward to a height generally proximate the fan deck. A downwardly and outwardly projecting substantially non-porous elongated upper air guide extends downwardly and outwardly from the side wall.

14 Claims, 3 Drawing Sheets

AIR GUIDE FOR AIR COOLED CONDENSER

FIELD OF THE INVENTION

The invention relates to the field of heat exchange towers, and more particularly relates to the field of towers which use tubes and coils to provide heat exchange to a fluid in the tubes and coils, such as, for example, an air cooled condenser tower.

BACKGROUND OF THE INVENTION

A wide variety of heat exchange towers are known in industry. Once such type of tower is an air cooled condenser (ACC) tower. Such a tower is typically a large box-like structure having an open lower frame. The open lower frame may be closed off on two of its sides. The open lower frame supports a deck having a series of fans which blow air upward so that the air is drawn in through the open sides of the tower and is forced upward by the fans. Above the fans the tower supports a series of condenser coils. In some examples, a plurality of steam supply header tubes run lengthwise on the top of the tower and dispense steam downward into angled downwardly extending condenser coils. In some examples, water is heated in a boiler to create steam, which is then sent to a high pressure end of a turbine to create work (via change in energy of the steam). The steam at the low pressure end of the turbine then is condensed by the condenser to create a vacuum that pulls the steam through the turbine. At the bottom of the angled downwardly extending condenser coils is a series of collection header tubes which receives condensed fluid and exits it from the tower. The entirety of the condenser coils is usually located above the fans. Air is exhausted out the open top of the tower past the steam supply header tubes.

Since the condensation coils are warmer compared to the ambient air entering the tower, as the air passes through the coils it tends to be warmed and tends to rise. This creates a natural draft which would draw some air into the sides of the tower below the coils and upward through the coils. However, it has generally been found in some applications that the natural draft is insufficient to provide a desired operation level. Therefore, in many instances a deck of the fans is added below the coils to provide a greater volume of air flow.

These systems have been found to be very satisfactory in use for condensing steam. However, it is always desirable to reduce the fan energy that must be input into the system in order to reduce the total energy cost of the system for a given temperature transfer given flow rate requirement of the condenser tower system. It is also desirable to improve the tower performance when subjected to winds from various angles, at least sometimes.

SUMMARY OF THE INVENTION

Some embodiments of the invention provide a condensing tower system and method that provides for efficient condensation of steam, or other efficient heat transfer to a fluid.

An aspect of the present invention provides an air cooled condensing tower system, comprising: a framework supporting a fan deck; a plurality of steam headers running longitudinally above the fan deck; a plurality of condenser coils extending downward and at an angle from the steam headers, and above the fan deck; a plurality of collector tubes disposed at the bottom of the condenser coils and above the fan deck; at least one substantially non-porous side wall disposed on at least one side of the tower and spanning from a height generally proximate the steam supply headers downward to a height generally proximate the fan deck; and a downwardly and outwardly projecting substantially non-porous elongated upper air guide extending downwardly and outwardly from the side wall.

Another aspect of the air cooled condensing tower system, comprising: means for supporting a fan deck; a plurality of steam headers running longitudinally above the fan deck; condensing means extending downward and at an angle from the steam headers, and above the fan deck; a plurality of collector tubes disposed at the bottom of the condensing means and above the fan deck; at least one substantially non-porous side wall disposed on at least one side of the tower and spanning from a height generally proximate the steam supply headers downward to a height generally proximate the fan deck; and a downwardly and outwardly projecting substantially non-porous elongated upper air guiding means extending downwardly and outwardly from the side wall.

A further aspect of the present invention in some embodiments provides a method of guiding air in an air cooled condensing tower system, comprising: supporting a fan deck with a framework; supplying steam to a plurality of steam headers running longitudinally above the fan deck; condensing steam using a plurality of condenser coils extending downward and at an angle from the steam headers, and above the fan deck; collecting condensate using a plurality of collector tubes disposed at the bottom of the condenser coils and above the fan deck; providing at least one substantially non-porous side wall disposed on at least one side of the tower and spanning from a height generally proximate the steam supply headers downward to a height generally proximate the fan deck; and guiding air using a downwardly and outwardly projecting substantially non-porous elongated upper air guide extending downwardly and outwardly from the side wall.

In another aspect of some embodiments, an air cooled condensing tower system comprises a framework supporting a fan deck having fan shrouds, a heat exchange coil disposed above the fan deck, at least one substantially non-porous side wall disposed on at least one side of the tower and defining an air inlet below the sidewall, and a downwardly and outwardly projecting substantially non-porous elongated upper air guide extending downwardly and outwardly from the side wall.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
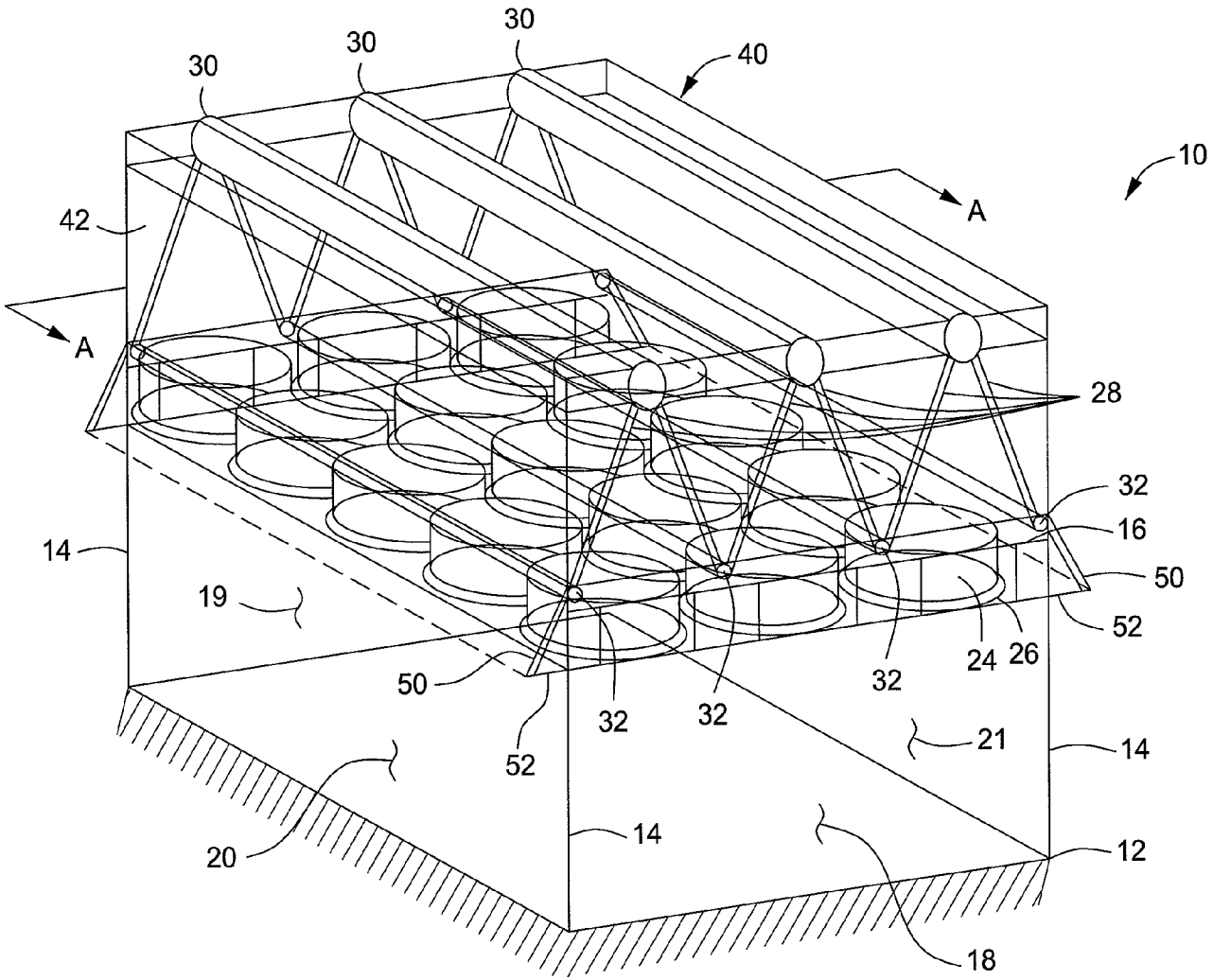
FIG. 1 is a schematic partially transparent overview of an air cooled condenser tower according to a preferred embodiment of the invention.

Some embodiments of the invention provide a condensing tower system and method that provides for efficient condensation of steam, or other efficient heat transfer to a fluid. Some examples of the present invention will now be described with reference to the drawings figures in which like reference numerals refer to like parts throughout.

Figure 2:
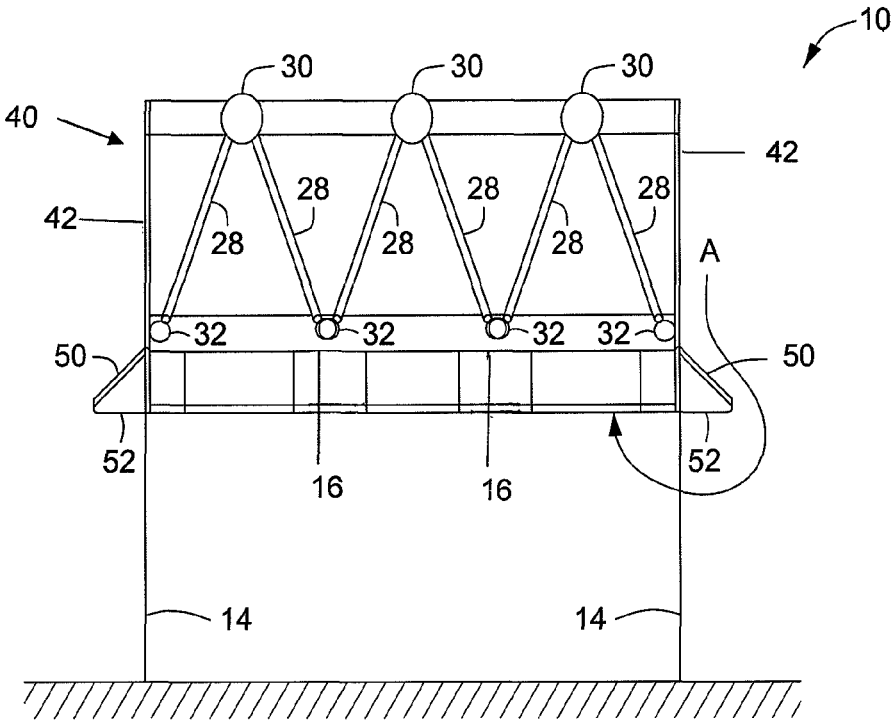
FIG. 2 is a first embodiment of an air cooled condenser tower.
Figure 3:
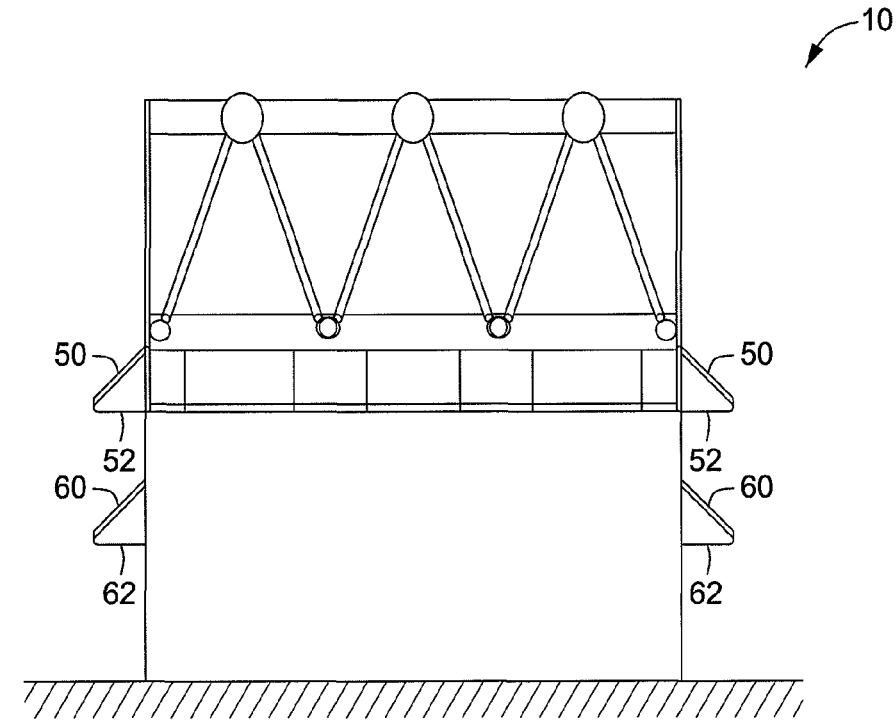
FIG. 3 is an end view of FIG. 1 as viewed from arrows A, but showing a second embodiment of the air cooled condenser tower.
Figure 4:
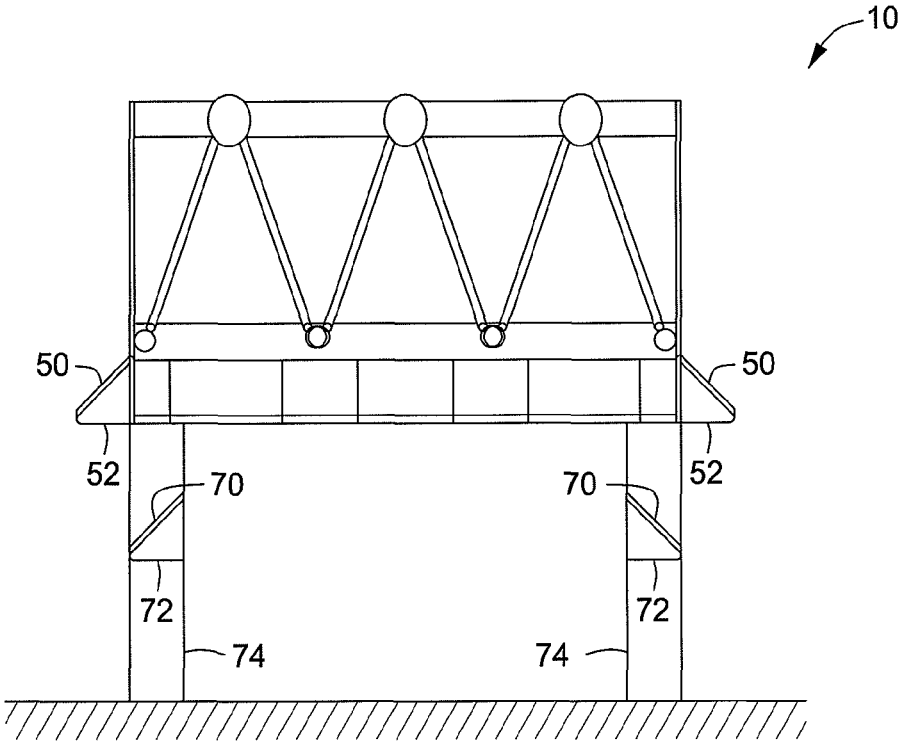
FIG. 4 is an end view of FIG. 1 as viewed from arrows A, but showing a third embodiment of the air cooled condenser tower.
Figure 5:
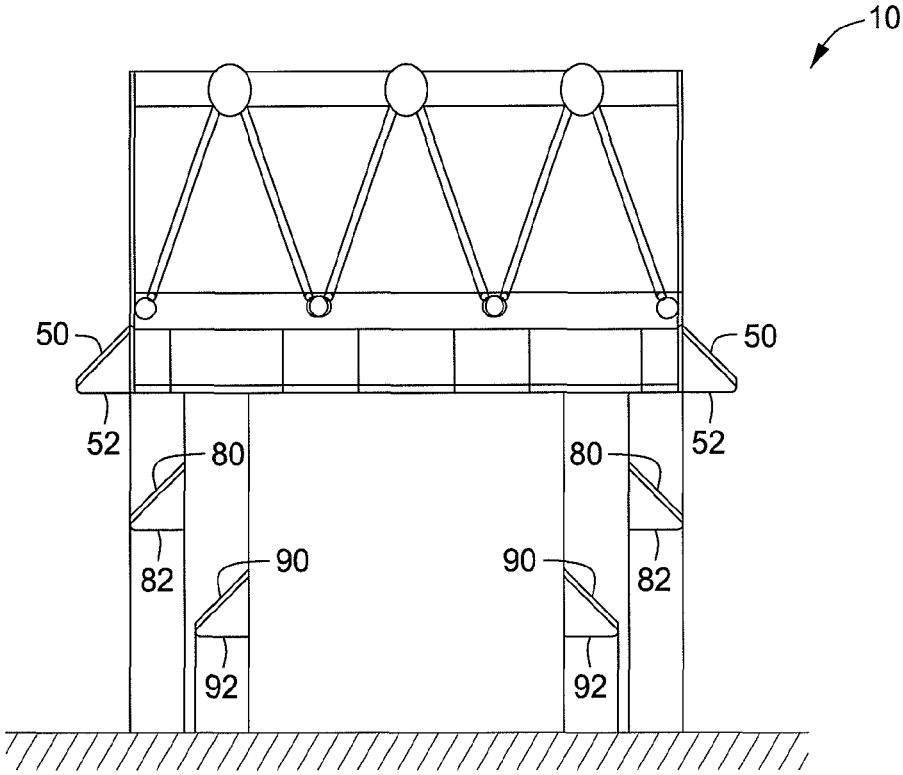
FIG. 5 is an end view of FIG. 1 as viewed from arrows A, but showing a fourth embodiment of the air cooled condenser tower.

FIG. 1 provides an overview of a tower structure according to a first preferred embodiment, which is also illustrated in FIG. 2. FIGS. 3, 4 and 5 describe variations which are second, third and fourth embodiments, respectively. These do not correspond exactly to the embodiment of FIG. 1, but it is believed that by reading the specification one skilled in the art will fully understand how the embodiment of FIG. 1 can be modified to conform to the second, third and fourth embodiments of FIGS. 3, 4, and 5, respectively.

Turning now to FIG. 1, an air cooled condensing tower 10 is shown. The tower includes a base 12 which rests on the ground and lower framework 14 which supports a fan deck 16. The lower framework 14 is shown simply as being legs at the corner of the tower. However, it will be appreciated by one skilled in the art that such a frame 14 is typically an internal lattice framework having columns and girts interconnected with each other to form an open frame. All four sides of the frame may be left open below the fan deck 16, or in some instances two of the opposed sides may each have a closed wall. The embodiments illustrated herein will be described in the context of having the two end walls labeled 18 and 19 as being closed and the two sides labeled 20 and 21 as being open. However, it will be appreciated that various embodiments in the invention may have any number of open or closed sides beneath the fan deck 16.

The fan deck 16 is a support structure which typically supports a plurality of individual fans 24 (blades not shown for clarity of illustration), each having their own fan shroud 26 associated therewith. The fan shrouds may have a cylindrical inner wall surrounding the fan, or may have some degree of a tapered profile as is known in the fan art. The fans 24 blow air upward past a series of angled condenser tube coil structures 28. The coils 28 are elongated coils generally forming a planar sheet-like structure which air can pass through. The coils 28 receive steam from a plurality of steam supply headers 30. The steam supply headers lead into the coils 28 and steam/water falls downward vertically through the coils 28 and is cooled by heat exchange with the ambient air outside the coils 28. The steam condenses into water which is collected in lower water collection headers 32 and discharged from the tower.

An upper frame structure 40 is typically provided to provide overall structural support to the area having the supply headers 30, condenser coils 28, and water headers 32. The coil and header pieces build into an upper superstructure. The frame structure 40 is simply framing for the casing. The casing may extend to approximately the bottom of the steam header or may extend some modest distance above the steam header. This upper frame 40 typically will have all four sides closed by solid or generally non-porous side walls or coverings 42 on all four sides. It will be appreciated that in FIG. 1 many solid items such as the side walls are shown being transparent so that an inner view of the tower 10 can be provided.

A feature of this preferred embodiment is the provision of two air inlet guides 50, one on each of opposed side areas of the tower. The air inlet guides 50 in some instances help direct the air flow of the corners formed by the lower ends of side walls 42, so the air can make an efficient turn generally in the region of the arrow A in FIG. 2. The solid side walls or coverings 42 generally extend at their upper end from a region near to or overlapping the height of the steam headers 30, and extend downwardly typically to approximately the height of the fan deck 16. The fan deck 16 refers to the plane where the fan shrouds attach to the tower. This plane is a plane typically above the upper edge of the shrouds.

Each air inlet guide 50 is an angled solid or generally non-porous sheet projecting downward and outward from the tower substantially in the configuration of an awning. The downwardly and outwardly projecting portion of the air guide or awning 50 can be manufactured from any suitable material such as, for example, sheet metal, plywood or other sheet wood, particle board, fiber reinforced plastic, or canvas. The air guide or awning 50 is illustrated being supported at its lower end by a horizontal support strut 52. In one example, a plurality of support struts 52 may be provided at regular lengths along the air guide 50, again, for example, as would be done with an awning. Although these lower struts 52 are illustrated in this embodiment, other embodiments of air guides are also possible, which might simply cantilever the air guide outward at 50 degrees, or the air guide 50 and its supports could have a solid or hollow triangular cross section. In the illustrated example, the lower edge of the awning 50 is substantially at the vertical height of the bottom edge of the fan deck 16.

The relative heights and positions can be further seen in FIG. 2. For example, FIG. 2 illustrates frames 14 which provide open lower sides to the tower. The fan deck 16 is illustrated, as are the steam headers 30, condenser tube sets 28 and water collection headers 32. The air guides or awnings 50 are seen projecting outward from the upper side walls 40 and 42, with support struts 52. The configuration of FIG. 2 can provide significant benefits compared to an otherwise identical configuration which would be missing the air guides 50. That is to say, if the air guides 50 (and their associated supports 52) are omitted, the air flow performance of the tower will in some cases be not as good as if the air guides 50 are present. The benefit of the air guides in some cases is more pronounced in the case of side winds. Thus, providing the air guides sometimes permits the same performance from the tower while using less fan energy than would be required for an identical tower without the air guides.

FIG. 3 illustrates an embodiment that is a variation of FIG. 2. In the embodiment of FIG. 3, the air guides 50 and 52 are the same as in FIG. 2, and the remaining tower structure is also the same with one difference. In the embodiment of FIG. 3, a second set of air guides 60 are provided, with their own tower support 62. In this embodiment, the air guides 60 have essentially an identical structure to the air guides 50, but are placed at a lower height. In this regard, although it is not separately illustrated, it is noted that another embodiment of the invention would include only the air guide 60, and could omit the air guides 50. The embodiment of FIG. 3 provides superior performance in some instances compared to a tower that does not have the air guides 50 and 60.

Turning next to FIG. 4, this figure shows an embodiment that is a variation on FIG. 3. In this embodiment, instead of the air guides 60 and supports 62 which extend outward from the vertical plane of the side walls of the tower, in the embodiment of FIG. 4 air guides 70 are provided which are inboard of the plane of the outside wall of the tower as shown. FIG. 4 shows air guides 70 in combination with air guides 50. The air guides 70 can be oriented by being mounted to existing internal framework, or the provision of additional internal framework 74 which is schematically illustrated. The horizontal struts 72 that are illustrated may also be provided by additional girts that are already present in the structure, or by additional struts or girts as is suitable. In the embodiment of FIG. 3, the upper inboard corner of the air guides 60 is located at the plane of the outside wall of the tower, and in the embodiment of FIG. 4, the lower outer corner of the air guides 70 is at the plane of the outside wall of the tower.

Turning next to the embodiment of FIG. 5, this shows another variation from the embodiment of FIG. 3. In this embodiment, upper outer air guides 50 are provided, with two sets of additional air guides 80 and 90. The air guides 80 are disposed inboard of the plane of the side of the tower, and thus are horizontally placed much like air guides 70, but in this example at a higher elevation off the ground. Additional air guides 90 are placed further inboard and lower than air guides 80. Air guides 80 and 90, since they are internal to the tower may be supported by existing girts and columns of the framework that is generally supporting the tower, or may be supported by individually provided columns and/or girts. Also, FIG. 5 illustrates simply by way of example horizontal struts 82 and 92 in this regard.

In some particular embodiments described herein, various air guides are provided. The air guides 50, 60, 70, 80 and 90 are generally oriented with their top surface being at an angle such that they have a dimension of 10 feet in a horizontal direction and 8 feet in the vertical direction. Thus, they are at an angle of preferably about 38 degrees to 40 degrees to horizontal. While this angle is preferred, in the example shown, it will be appreciated that depending on a wide variety of atmospheric and system conditions, other angles may be preferable in certain instances.

The above illustrated embodiments provide examples having various air guides disposed at an angle located outboard or inboard of the tower structure, and generally proximate the height of the fan deck, or below the fan deck. While specific generally proximate the height of the fan deck, or below the fan deck. While specific examples of the variations of air guides is provided, it will be appreciated that other variations of locations of air guides may fall within the scope of the invention, and that, for example, where a lower inboard air guide is illustrated in combination with an outer air guide, other embodiments of the invention would include just the lower inboard air guides without the upper outer air guides. Thus, the examples are shown as examples only.

In the various embodiments discussed above, an illustrated embodiment has air guides on two of its four sides, with the other two sides being solid walls along their entire vertical side. However, other embodiments which have three or four open sides may or may not have an air guide on the other open sides. For example, many ACC's have all four sides open and in some embodiments air guides are provided on all sides, so the drawing figures would be applicable taken towards any side. Further, although the illustrated embodiment puts an air guide on two sides of the tower, putting an air guide on only one side may also be advantageous in some examples.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An air cooled condensing tower system having an outside perimeter and a vertical axis and a horizontal axis, comprising:

a first framework supporting a fan deck having fan shrouds, said first framework extends within a first vertical plane positioned at a first position along the horizontal axis, wherein said first vertical plane defines the outside perimeter of the air cooled condenser;

a second supporting framework, said second framework extends within a second vertical plane positioned at a second position along the horizontal axis, inboard of said first vertical plane;

a plurality of steam headers running longitudinally above the fan deck;

a plurality of condenser coils extending downward and at an angle from the steam headers, and above the fan deck;

a plurality of collector tubes disposed at the bottom of the condenser coils and above the fan deck;

at least one substantially non-porous side wall disposed on at least one side of the tower and spanning from a height generally proximate the steam supply headers downward to a height generally proximate the fan deck;

a downwardly and outwardly projecting elongated upper air guide extending downwardly and outwardly from the side wall, wherein said upper air guide is positioned proximate to the fan deck and on said first supporting framework;

at least one supplemental air guide extending downwardly and outwardly from the second supporting framework, and disposed beneath the upper air guide, and having an upper end terminating in the plane of the second supporting framework and a lower end extending outwardly and downwardly therefrom, wherein the upper air guide and supplemental air guide each comprise a plurality of support struts a third supporting framework, said third framework extends within a third vertical plane positioned at a third position along the horizontal axis, inboard of said first and second vertical planes; and at least one third supplemental air guide extending downwardly and outwardly from the third supporting framework, and disposed beneath the upper air guide, and having an upper end terminating in said third vertical plane that is inboard of the side wall, and a lower end extending outwardly and downwardly therefrom, wherein the second supplemental air guide is inboard of the outside perimeter of the tower, and the third supplemental air guide being entirely inboard of the second supplemental air guide.

2. The system of claim 1, wherein the upper air guide has an upper end that meets the side wall generally at a height of the fan deck, and has a lower end that terminates generally at a height of the bottom of the fan shrouds.

3. The system of claim 1, wherein the upper air guide has the configuration of an awning.

4. The system of claim 1, wherein the upper air guide has a top surface angled at an angle of between approximately 38 degrees to 40 degrees to horizontal.

5. The air cooled condensing tower system according to claim 1, wherein the upper air guide is substantially non-porous.

6. An air cooled condensing tower system having an outside perimeter and a vertical axis and a horizontal axis, comprising:

a first means for supporting a fan deck having fan shrouds said first means for supporting extends within a first vertical plane positioned at a first position along the horizontal axis, wherein said first vertical plane defines the outside perimeter of the air cooled condenser;

a second means for supporting, said second means for supporting extends within a second vertical plane positioned at a second position along the horizontal axis, inboard of said first vertical plane;

a plurality of steam headers running longitudinally above the fan deck;

condensing means extending downward and at an angle from the steam headers, and above the fan deck;

a plurality of collector tubes disposed at the bottom of the condensing means and above the fan deck;

at least one substantially non-porous side wall disposed on at least one side of the tower and spanning from a height generally proximate the steam supply headers downward to a height generally proximate the fan deck and on said first means for supporting;

a downwardly and outwardly projecting elongated first air guiding means extending downwardly and outwardly from the side wall positioned proximate to said means for supporting a fan deck, wherein the first air guiding means has the configuration of an awning;

at least one second supplemental air guiding means extending downwardly and outwardly from the second supporting framework, and disposed beneath the first air guiding means, and having an upper end terminating in the plane of the second supporting means and a lower end extending outwardly and downwardly therefrom wherein the upper air guide and supplemental air guide each comprise a plurality of support struts; and a third means for support, said third means for support extends within a third vertical plane positioned at a third position along the horizontal axis, inboard of said first and second vertical planes; and at least one third supplemental air guiding means extending downwardly and outwardly from the third means for support, and disposed beneath the first air guiding means, and having an upper end terminating in said third vertical plane that is inboard of the side wall, and a lower end extending outwardly and downwardly therefrom, wherein the second supplemental air guiding means is inboard of the outside perimeter of the tower, and the third supplemental air guiding means being entirely inboard of the second supplemental air guiding means.

7. The system of claim 6, wherein the first air guiding means has an upper end that meets the side wall generally at a height of the fan deck, and has a lower end that terminates generally at a height of the bottom of the fan shrouds.

8. The air cooled condensing tower system according to claim 6, wherein the first air guiding means is substantially non-porous.

9. A method of guiding air in an air cooled condensing tower system having an outside perimeter and a vertical axis and a horizontal axis, comprising:

supporting a fan deck having fan shrouds with a framework, where is said framework comprises:

a first framework supporting a fan deck having fan shrouds, said first framework extends within a first vertical plane positioned at a first position along the horizontal axis, wherein said first vertical plane defines the outside perimeter of the air cooled condenser; and a second supporting framework, said second framework extends within a second vertical plane positioned at a second position along the horizontal axis, inboard of said first vertical plane;

supplying steam to a plurality of steam headers running longitudinally above the fan deck;

condensing steam using a plurality of condenser coils extending downward and at an angle from the steam headers, and above the fan deck;

collecting condensate using a plurality of collector tubes disposed at the bottom of the condenser coils and above the fan deck;

providing at least one substantially non-porous side wall disposed on at least one side of the tower and spanning from a height generally proximate the steam supply headers downward to a height generally proximate the fan deck, wherein said side wall lies in the first vertical plane;

guiding air using a downwardly and outwardly projecting elongated upper air guide extending downwardly and outwardly from the side wall and first vertical plane;

guiding air using at least one first supplemental air guide extending downwardly and outwardly from the second supporting framework, and disposed beneath the upper air guide, and having an upper end terminating in the plane of the second supporting framework and a lower end extending outwardly and downwardly therefrom wherein the upper air guide and supplemental air guide each comprise a plurality of support struts; and a third supporting framework, said third framework extends within a third vertical plane positioned at a third position along the horizontal axis, inboard of said first and second vertical planes; and guiding air using at least one third supplemental air guide extending downwardly and outwardly from the third supporting framework, and disposed beneath the upper air guide, and having an upper end terminating in said third vertical plane that is inboard of the side wall, and a lower end extending outwardly and downwardly therefrom, wherein the second supplemental air guide is inboard of the outside perimeter of the tower, and the third supplemental air guide being entirely inboard of the second supplemental air guide.

10. The method of claim 9, wherein the upper air guide has an upper end that meets the side wall generally at a height of the fan deck, and has a lower end that terminates generally at a height of the bottom of the fan shrouds.

11. The method of claim 9, wherein the upper air guide has the configuration of an awning.

12. The air cooled condensing tower system according to claim 9, wherein the upper air guiding is substantially non-porous.

13. An air cooled condensing tower system having an outside perimeter and a vertical axis and horizontal axis, comprising:

a framework supporting a fan deck having fan shrouds, wherein said framework comprises a first support structure that extends within a first vertical plane positioned at a first position along the horizontal axis, wherein said first vertical plane defines the outside perimeter of the air cooled condenser; and a second support structure that extends within a second vertical plane positioned at a second position along the horizontal axis, inboard of said first vertical plane;

a heat exchange coil disposed above the fan deck;

at least one substantially non-porous side wall disposed on at least one side of the tower and defining an air inlet below the side wall, wherein said side wall lies in the first vertical plane;

a first downwardly and outwardly projecting elongated air guide extending downwardly and outwardly from the side wall and the first vertical plane;

a second downwardly and outwardly projecting elongated air guide extending downwardly and outwardly from the second vertical plane, wherein said second air guide is positioned vertically below said first air guide wherein the upper air guide and supplemental air guide each comprise a plurality of support struts; and a third supporting framework, said third framework extends within a third vertical plane positioned at a third position along the horizontal axis, inboard of said first and second vertical planes; and guiding air using at least one third supplemental air guide extending downwardly and outwardly from the third supporting framework, and disposed beneath the upper air guide, and having an upper end terminating in a vertical plane that is inboard of the side wall, and a lower end extending outwardly and downwardly therefrom, and terminating generally proximate or at the plane of the side wall so that the second supplemental air guide is inboard of the outside perimeter of the tower, and the third supplemental air guide being entirely inboard of the second supplemental air guide.

14. The air cooled condensing tower system according to claim 13, wherein the air guide is substantially non-porous.

* * * * *